United States Patent [19]

Fukuda

[11] Patent Number: 4,945,820

[45] Date of Patent: Aug. 7, 1990

[54] AIR CIRCULATING DEVICE

[76] Inventor: Kouzo Fukuda, 2 - 19 - 1 Mishikamakura, Kamakura-shi, Kanagawa-ken, Japan

[21] Appl. No.: 333,406

[22] Filed: Apr. 5, 1989

[51] Int. Cl.[5] ..... F24F 7/06

[52] U.S. Cl. ..... 98/31.5

[58] Field of Search ..... 98/31.5, 31.6

[56] References Cited

U.S. PATENT DOCUMENTS

| | | | |
|---|---|---|---|
| 3,347,025 | 10/1967 | Wiley | 98/31.5 X |
| 3,827,342 | 8/1974 | Hughes | 98/31.5 |
| 4,136,606 | 1/1979 | Wolbrink | 98/31.5 |

FOREIGN PATENT DOCUMENTS

| | | | |
|---|---|---|---|
| 2279031 | 2/1976 | France | 98/31.5 |
| 62336 | 4/1982 | Japan | 98/31.5 |
| 11037 | 1/1985 | Japan | 98/31.5 |

*Primary Examiner*—Harold Joyce

*Attorney, Agent, or Firm*—Armstrong, Nikaido, Marmelstein, Kubovcik & Murray

[57] ABSTRACT

An air-circulating device which can be employed in rooms having different sizes and comprises a base adapted to be mounted on a room wall, a first duct attached to the base and having a first air port, a second duct attached to the base and having a second air port and at least one air circulating fan mounted within the base for circulating the air within the room through the ducts.

4 Claims, 2 Drawing Sheets

AIR CIRCULATING DEVICE

BACKGROUND OF THE INVENTION

This invention relates to an air circulating device and more particularly to an improved air circulating device whereby air present in a region adjacent to the ceiling of a room and air present in a region adjacent to the floor of the room are effectively circulated.

PRIOR ARTS

As prior art air circulating devices, there have been known a device comprising a hollow box which is provided at one end with a room air suction port and at the other end with an air discharge port and a fan mounted within the box to draw the room air into and out of the box as disclosed in Japanese Laid-Open Patent Appln. Publication No. 49945/1966, a device comprising partition screens or walls dividing the inerior of a room into compartments and each having upper and lower ventilation holes, an air flow path communicating between the upper and lower ventilation holes in each partition screen or wall and a fan disposed within the air flow path extending between the upper and lower ventilation holes as disclosed in Japanese Laid-Open U.M. Appln. Publication No. 176042/1965 and devices in which each receiving shoulder is provided with upper and lower air suction and discharge holes in communication with each other by means of an air communication path and a fan is disposed within the air communication path as disclosed in Japanese Laid-Open N.M. Applns. Nos. 116934 and 170936/1966.

However, in the prior art air circulating devices described hereinabove, since the box or receiving shoulder adapted to be disposed on the floor of a room is provided at the upper and lower ends with the air suction and discharge holes, the disposition of the holes in regions in proximity to the ceiling or floor of a room is subjected to limitation. Thus, the air within the room can not be satisfactorily circulated. Especially, in a room where heating and/or cooling facilities are installed, air present in a region adjacent to the ceiling and that present in a region adjacent to the floor are substantially different in temperature and thus, in order to maintain the temperature in the room uniform, the air suction and discharge holes are preferably disposed in proximity to the room ceiling and floor, respectively. In order to attain highly efficient air circulation, air circulating devices having different heights which can be employed in rooms having different heights have to be manufactured.

In addition, the above-mentioned prior art air circulating devices are inevitably large in size because tha devices are in the forms of boxes and receiving shoulders.

SUMMARY OF THE INVENTION

The present invention has its object to provide an improved air circulating device which can eliminate the above-mentioned drawbacks inherent in the prior art air ciculating devices.

In order to attain the object, in one aspect of the present invention, there is provided an air circulating device which comprises a base adapted to be attached to the surface of a room wall and having air circulating fans disposed therein, a first duct attached at one end to one end of said base and having at the other end a first air port and a second duct attached at one end to the other end of said base and having a second air port, said first and second ducts being attached to said base for displacement towards and away from each other.

In use, the base is rotatably mounted on the surface of a room wall and the first and second ducts are attached to the base for displacement relative to each other. Thus, the air ports in the first and second ducts can be disposed in positions adjacent to the room ceiling and floor, respectively and the single air circulating device can be emplyed in rooms having different heights.

The above and other objects and attendant advantages of the present invention will be more readily apparent to those skilled in the art from a reading of the following detailed description in conjunction with the accompanying drawings which show preferred embodiments of the invention for illustration purpose only, but not for limiting the scope of the same in any way.

PREFERRED EMBODIMENTS OF THE INVENTION

Figure 1:
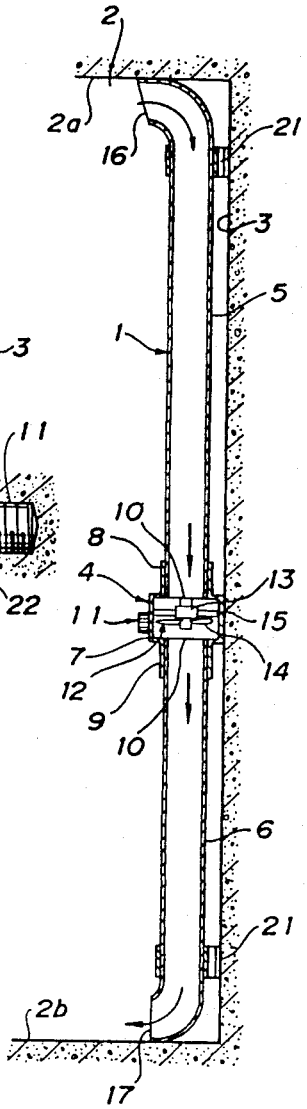
FIG. 1 is a side elevational view in vertical section of one embodiment of the air circulating device constructed in accordance with the principle of the present invation showing the device as being mounted on the surface of a room wall.
Figure 2:
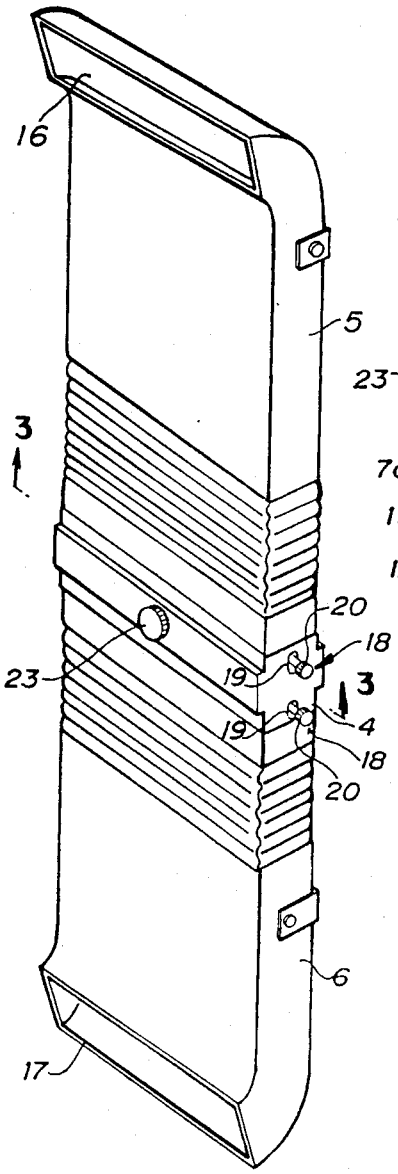
FIG. 2 is a perspective of the air circulating device as shown in FIG. 1.
Figure 3:
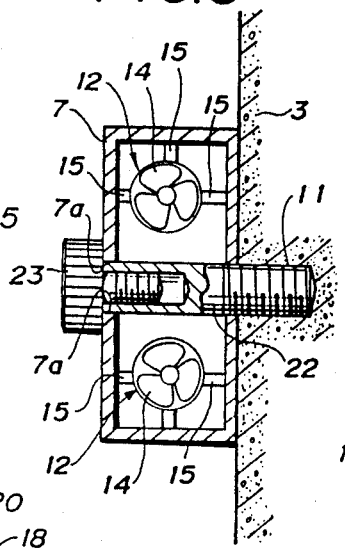
FIG. 3 is a cross-sectional view taken along the line A—A of FIG. 2.

The present invention will be now described referring to the accompanying drawings and more particularly to FIGS. 1 to 3 wherein the first embodiment of the air circulating device according to the present invention is shown. In FIG. 1, the device 1 is shown as being mounted on the surface 3 of a wall in a room 2 and the air circulating device 1 generally comprises a base 4, a first duct 5 attached at one or the lower end to one or the upper end of the base 4 and a second duct 6 attached at one or the lower end to the other or lower end of the base 4. As more clearly shown in FIG. 2, the base 4, first duct and second duct 6 are substantially rectangular in cross-sectional shape, but the parts are not limited to such a shape in the present invention.

As more clearly shown in FIG. 1, the base 4 comprises a hollow body 7, a first cylindrical portion 8 formed on one or the upper surface of the body 7 surrounding the first duct 5 and a second cylindrical portion 9 formed on the other or lower surface of the body 7. Partition walls between the body and the first and second cylindrical portions, 8, 9, respectively, are formed with air flow holes 10.

The body 7 can be rotatably mounted on the wall surface 3 by means of mounting means 11 of which description will be made hereinafter.

Air circulating fans 12 are disposed within the body 7 in spaced relationship (FIGS. 1 and 3). In the illustrated embodiment, although the two air circulating fans 12 are provided, only one air circulating fan or air circulating fans in numbers more than two can be employed within the scope of the present invention.

In the illustrated embodiment, each fan 12 comprises a motor 13 and vanes 14 to be rotated by the motor 13. The vanes are designed to cause air to flow from the first duct 5 to the second duct 6.

The motor 13 are supported on the inner wall of the body by means of a plurality of support bars 15.

One or the lower end of the first duct 5 is fitted in the first cylindrical portion 8 of the body 7 and one or the upper end of the second duct 6 is fitted in the second cylindrical portion 9.

One or the upper end of the first duct 5 is formed with a first air port 16 and one or the lower end of the second duct 6 is formed with a second air port 17. The first air port 16 is disposed adjacent to the ceiling 2*a* of the room and the second air port 17 is disposed adjacent to the floor 2*b* of the room.

The positions of the first duct 5 and second duct 6 can be adjusted by means of adjusting means 18 relative to the first cylindrical portion 8 and second cylindrical portion 9; respectively.

Each adjusting means 18 comprises a slit 19 formed in the first cylinfrical portion 8 or the second cylindrical portion 9 and a bolt 20 screwed in the slit 19. These adjusting means are provided on the opposite ends of the first duct 5 and the second duct 6, respectively. Thus, the first and second ducts are adjustable in the longitudinal direction of the device 1 and held in position by fastening the bolts 20. And if necessary, the first and second ducts can be secured to the wall surface by optional securing means 21 disposed about the first and second ducts 5, 6.

The mounting means 11 for mounting the base 4 on the wall surface 3 comprises a substantially hollow transverse threaded bar 22 screwed in a threaded bore 7*a* formed in the body 7 and a fastening screw 23 screwed in the threated bar 22. Thus, when the fastening screw 23 is loosened, the base 4 can be rotated relative to the wall surface and when the screw is fastened, the base can be firmly held against the wall surface 3.

The operation of the air circulating device will be in brief described. First of all, the threaded bar 22 is screwed into a predetermined room wall and the fastening screw 23 is screwed into the bore 7*a* in the body 7 whereby the base 4 is attached to the threaded bar 22. Next, the first duct 5 and second duct 6 are inserted into the first cylindrical portion 8 and second cylindrical portion 9, respectively and the bolts 20 are screwed into the first duct 5 and second duct 6 through the slits 19 whereby the first and second ducts are secured to the base. At this time, it is necessary that the first air port 16 of the first duct 5 is positioned in a position near to the room ceiling 2*a* and the second air port 17 of the second duct 6 is potitioned in a position near to the room floor 2*b*. Next, if necessary, the securing means 21 are employed to secure the first and second ducts to the wall surface. When the fans 12 are driven with the first and second ducts secured to the wall surface as mentioned above, air present in a region adjacent to the ceiling 2*a* of the room is introduced into the air port 16, passes through the first duct 5, the air flow holes 10 and the second duct 6 and discharges at the second air port 17. In this case, warm air present in a region adjacent to the ceiling of the room can be distributed to the room floor whereby the room is heated.

When the room is desired to be cooled, in order to distribute cool air present in a region adjacent to the room floor to a region adjacent to the room ceiling, the securing means are released from the first and second ducts and the bolts 20 are loosened. Thereafter, the first and second ducts 5, 6 are drawn towards each other to thereby shorten the length of the air circulating device. Next, the fastening screw 22 is loosened to allow the base 4 to a be rotated and the positions of the first duct 5 and second duct 6 are reversed, that is, the first duct 5 is disposed below the second duct 6. Then, the base and first and second ducts 5, 6 are held in position.

With the parts held in position, the cool air present in a region adjacent to the ceiling is introduced into the first air port 16, passes through the first duct 5, air flow holes 15 and duct 6 and discharges at the second air port 17 to reach a region adjacent to the room ceiling.

Figure 4:
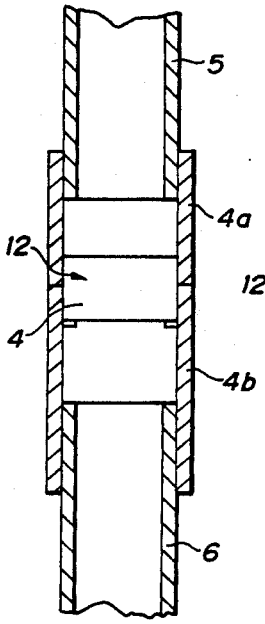
FIG. 4 is a fragmentary vertically sectional view of another embodiment of the air circulating device of the present invention.

In the second embodiment shown in FIG. 4, the base 4 comprises a first cylindrical portion 4*a* and a second cylindrical portion 4*b* detachably attached to the first cylindrical portion 4*a*. The first cylindrical portion 4*b* slidably receives one end of the first duct 5, and the second cylindrical portion 4*b* slidably receives one end of the second duct 6. In the second embodiment, the first duct and first cylindrical portion and the second duct and second cylindrical portion are connected together, respectively, in telescopic relationship without the use of any securing means.

Instead, the first and second ducts are secured to a room wall by the securing means 21 as employed in the first embodiment. The securing means is preferably a two-side adhesive tape so that the securing means can be easily secured to the wall surface. In this embodiment, only one fan 12 is amounted on a shoulder formed on the inner surface of the second cylindrical portion 4*b*. The rotational direction of the fan can be reversed after the first and second cylindrical portions have been separated from each other. Thus, the fan can function for both cooling and heating purposes.

Figure 5:
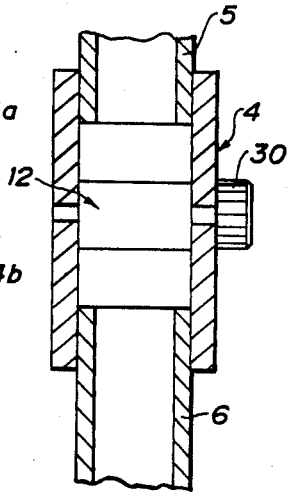
FIG. 5 is a fragmentary vertically sectional view of another embodiment of the air circulating device of the present invention.

In the embodiment showing FIG. 5, the single fan 12 is rotatably mounted on the base 4 and can be reversively rotated by a knob 30. In this case, the fan can be locked in a predetermined position by lock means (not shown).

Figure 6:
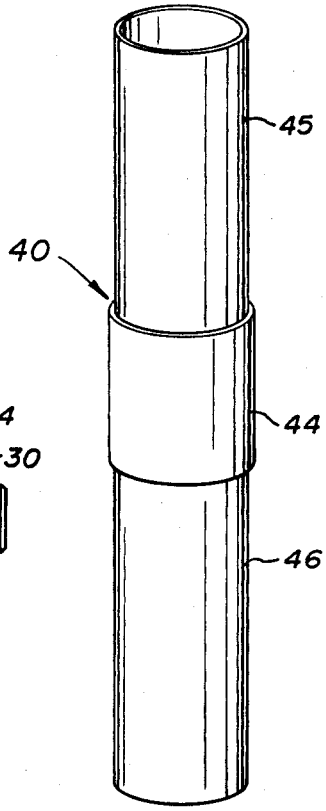
FIG. 6 is similar to FIG. 2, but shows another embodiment of the air circulating device of the present invention.

FIG. 6 shows a further embodiment of the air circulating device of the present invention. The embodiment is genrally shown by reference numeral 40 and comprises a base 44, a first duct 45 and a second duct 46 which are circular in cross-section. The device functions like the other embodiments described hereinabove.

In the above-mentioned embodiments, the first duct and second ducts and base are formed of plastic.

According to the present invention, since warm air present in a region adjacent to the ceiling of a room is caused to flow to a region adjacent to the floor of the room and cool air present in a region adjacent to the floor of the room is caused to flow a region adjacent to the ceiling of the room and thus, the air within the room is circulated to thereby maintain the room temperature uniform. In addition, since the first and second ducts can be displaced towards each other and away from each other, the air circulating device can be employed in rooms having different sizes and is simple in operation. Furthermore, since the whole device is of knock-down type, the device can be easily assembled and transported.

While preferred embodiments of the invention have been shown and described in detail, it will be understood that the same are illustration purpose only and not to be taken as a definition of the invention, and reference should be given to the appended claims for that purpose.

What is claimed is:

1. An air circulating device comprising a base adapted to be mounted on the surface of a room wall, a first duct attached at one end thereof to one end of said base and having a first air port at the other end thereof, a second duct attached at one end thereof to the other end of said base and having a second air port at the other end thereof and at least one air circulating fan mounted within said base, wherein said base has a pair of elongated slots each extending along a longitudinal direction of said air circulating device and each of said first and second ducts is provided with a bolt to be inserted into one of said elongated slots such that said first and second ducts are longitudinally adjustably attached to said base and further wherein said base is provided with a pivotable mounting means for securing said base against said wall such that the positions of said first and second ducts can be interchanged.

2. The air circulating device as set forth in claim 1, wherein said fan comprises a motor supported on an inner wall of said base by means of at least one bar and vanes driven by said motor.

3. The air circulating device as set forth in claim 1 or 2, wherein two fans are mounted within said base in a spaced relationship to each other.

4. The air circulating device as set forth in claim 1, wherein said mounting means comprises a substantially hollow threaded bar adapted to be screwed into bores formed in said base and the surface of said room wall and a fastening screw adapted to be screwed into said hollow threaded bar.

* * * * *

UNITED STATES PATENT AND TRADEMARK OFFICE

CERTIFICATE OF CORRECTION

PATENT NO. : 4,945,820

DATED : August 7, 1990

INVENTOR(S) : Kouzo FUKUDA

It is certified that error appears in the above-identified patent and that said Letters Patent is hereby corrected as shown below:

On the cover page, after Item [22], the following should read:

--[30] Foreign Application Priority Data

Apr. 8, 1988 [JP] Japan ..... 63-47471[U]--.

Signed and Sealed this

Twenty-fourth Day of December, 1991

*Attest:*

HARRY F. MANBECK, JR.

*Attesting Officer*

*Commissioner of Patents and Trademarks*